United States Patent [19]

Bratten

[11] Patent Number: 5,004,012

[45] **Date of Patent: * Apr. 2, 1991**

[54] AUTOMATIC WATER SHUT-OFF APPARATUS FOR BUILDING PROTECTION

[76] Inventor: David R. Bratten, 322 Greenway Rd., Memphis, Tenn. 38117

[ * ] Notice: The portion of the term of this patent subsequent to May 1, 2007 has been disclaimed.

[21] Appl. No.: 514,084

[22] Filed: Apr. 25, 1990

Related U.S. Application Data

[63] Continuation-in-part of Ser. No. 407,212, Sep. 14, 1989, Pat. No. 4,921,012.

[51] Int. Cl.[5] ..... G08B 15/00

[52] U.S. Cl. ..... 137/560; 137/599

[58] Field of Search ..... 137/599, 560; 116/6; 251/129.03, 129.04

[56] References Cited

U.S. PATENT DOCUMENTS

| | | | |
|---|---|---|---|
| 3,580,282 | 5/1971 | Van Arsdale . | |
| 3,904,167 | 9/1975 | Touch et al. | 251/14 |
| 3,941,349 | 3/1976 | Pierson | 251/129.03 X |
| 3,947,838 | 3/1976 | La Forge | 340/544 |
| 4,141,383 | 2/1979 | Geimer | 251/129.03 X |
| 4,294,404 | 10/1981 | Gajjar | 236/94 X |
| 4,308,911 | 1/1982 | Mandl | 340/521 X |
| 4,643,224 | 2/1987 | Rung et al. | 137/599 X |
| 4,651,777 | 3/1987 | Hardman | 137/487 |
| 4,779,839 | 10/1988 | Sears | 251/68 |

*Primary Examiner*—Stephen M. Hepperle
*Attorney, Agent, or Firm*—Walker & McKenzie

[57] ABSTRACT

An automatic water shut-off apparatus for connection to an intrusion alarm system, such as a burglar alarm, that provides for protection of a building from water damage while the alarm is armed. A valve, which controls water flow into the building, is closed whenever the alarm system is armed, thus preventing water damage while the building is unattended. A manual shut-off switch is also provided to close the valve and shut off the water when the alarm system is disarmed or for maintenance. A manual bypass valve may be provided to allow water flow into the building in the event of electrical failure.

8 Claims, 2 Drawing Sheets

AUTOMATIC WATER SHUT-OFF APPARATUS FOR BUILDING PROTECTION

CROSS-REFERENCE TO RELATED APPLICATION

This is a continuation-in-part of my application, Ser. No. 07/407,212, filed Sept. 14, 1989, now U.S. Pat. No. 4,921,012 entitled "Automatic Water Shut-off Apparatus For Building Protection".

BACKGROUND OF THE INVENTION

1. Field of the Invention

The present invention relates, in general, to apparatus for protection of buildings from water damage, and in particular, to an automatic water shut-off apparatus for protection of a building from water damage which may be attached to an intrusion alarm system, such as a burglar alarm.

2. Information Disclosure Statement

A preliminary patentability search in Class 137, subclass 870, Class 340, subclasses 603 and 605, and Class 251, subclass 129.04, produced the following patents: Van Arsdale et al., U.S. Pat. No. 3,580,282, issued May 25, 1971; Touch et al., U.S. Pat. No. 3,904,167, issued Sept. 9, 1975; Hardman, U.S. Pat. No. 4,651,777, issued Mar. 24, 1987; and Sears, U.S. Pat. No. 4,779,839, issued Oct. 25, 1988. While each of the above patents disclose various electrically controlled valve systems, none disclose or suggest the present invention. More specifically, none of the above patents disclose or suggest an automatic water shut-off apparatus for protection of a building from water damage for attachment to an intrusion alarm system, such as a burglar alarm.

Touch et al., U.S. Pat. No. 3,904,167, describes an electric water faucet operated through the use of switches controlling electrical solenoids. A manual control is also described to operate the faucet in the event of electrical power failure. However, there is no suggestion nor mention of attachment to an intrusion alarm system for automatic shut-off of water when the alarm system is armed.

Hardman, U.S. Pat. No. 4,651,777, describes an electronic control apparatus which operates a solenoid-driven water valve assembly. The control apparatus includes a microphonic circuit which responds to audio signals, which turns the water on and off in response to audible signals. However, Hardman does not suggest the present invention, namely an automatic water shut-off apparatus for protection of a building from water damage which may be attached to an intrusion alarm system for automatic shut-off of water when the alarm system is armed.

Sears, U.S. Pat. No. 4,779,839, describes a system for actuating an electrical valve from a remote location. A battery powered circuit is described which may be activated remotely by a unique signal to shut off the water, and also to provide a remote means for indicating actuation of the valve. No mention is made of an automatic shut-off apparatus for protection of a building from water damage which may be attached to an intrusion alarm system.

Van Arsdale et al., U.S. Pat. No. 3,580,282, describes a valve operating system for hydraulic double-acting power valves. No mention is made of an automatic shut-off apparatus for protection of a building from water damage which may be attached to an intrusion alarm system.

Also, the following patents were cited by the Patent Examiner in the prosecution of my said application Ser. No. 07/407,212, none of which disclose or suggest the present invention: Geimer, U.S. Pat. No. 4,141,383; Pierson, U.S. Pat. No. 3,941,349; Gajjar, U.S. Pat. No. 4,294,404; La Forge, U.S. Pat. No. 3,947,838; Mandl, U.S. Pat. No. 4,308,911; and Rung et al, U.S. Pat. No. 4,643,224.

SUMMARY OF THE INVENTION

The present invention is directed toward providing an automatic water shut-off apparatus for protection of a building from water damage. The apparatus may be attached to an intrusion alarm system, such as a burglar alarm, and shuts off the flow of water to the building when the alarm system is armed. Those skilled in the art of building construction and maintenance are familiar with the occurrence of pipes bursting in buildings, such as homes or businesses, while the buildings are vacant. Water damage resulting from frozen or broken water pipes can be severe.

In a building equipped with an intrusion alarm system, it is common to activate, or "arm", the alarm system during periods when the building will be vacant. The present invention provides a means for automatically shutting off the primary water supply to the building when the alarm system is in the armed condition. By turning off a building's water supply whenever the alarm system is in the armed condition, ie., whenever the building is vacant, the chances of substantial water damage are greatly reduced. Even if the pipes have burst while the building was vacant, the present invention provides a means for manually shutting off the primary water supply to the building when the alarm is disarmed, or in a "safe" condition. This manual shut-off means may be used in case of a leak or when performing maintenance. A separate manual bypass means may optionally be provided to allow the primary water supply to flow into the building in case of a malfunction or in the event of power failure to the apparatus.

Those skilled in the art of alarm systems will be aware that it is common for intrusion alarm systems to provide a circuit which is activated only when the alarm system is in the armed condition. Such a circuit is typically used for connection to an indicating means, such as a light, indicating that the alarm is armed. The present invention monitors this circuit and automatically shuts off the primary water supply to the building whenever the alarm system is armed.

DESCRIPTION OF THE PREFERRED EMBODIMENT

Figure 1:
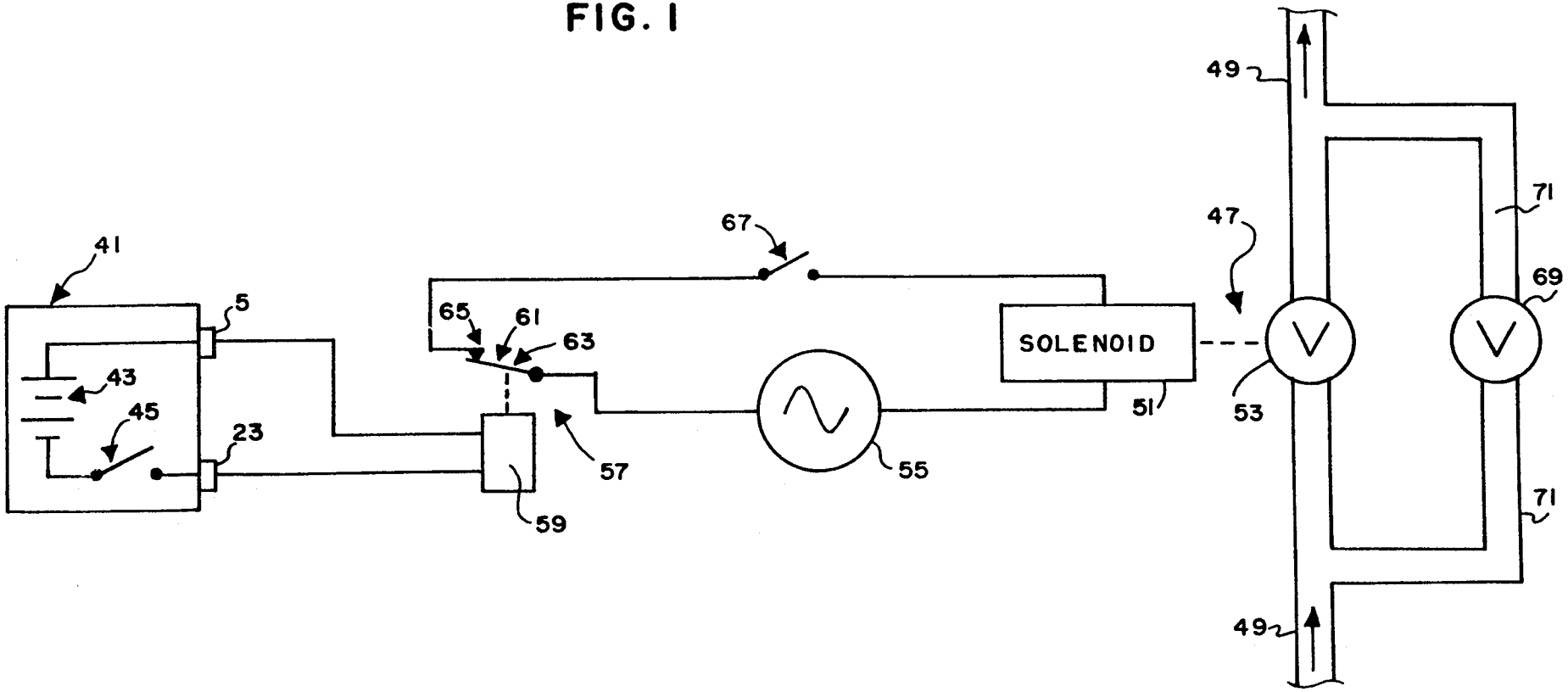
FIG. 1 is a diagram showing the present invention attached to an intrusion alarm system and controlling the primary water supply to a building.

The preferred embodiment of the present invention is shown in FIG. 1, attached to intrusion alarm system 41 for a building, such as a burglar alarm. Alarm system 41 includes a power source 43 and may be connected to an alarm, not shown, such as a light or a bell, in a manner well-known to those skilled in the art. Alarm system 41 has an arming circuit, shown symbolically as switch 45, which places the alarm system into either an armed condition, in which the building is monitored for intrusion, or a safe condition, in which the alarm system is disarmed, in a manner well-known to those skilled in the art. Alarm system 41 also includes terminals 5 and 23 which develop a electrical potential whenever the alarm system is in the armed condition.

Valve means 47, well-known to those skilled in the art, is provided for insertion into the primary water supply 49 of the building. Valve means 47 may be operated by any number of different means as for example by electricity, air, hydraulics, servo, or other means as will now be apparent to those skilled in the art. Preferably, valve means 47 is electrically operated as shown in FIG. 1. Thus, in the preferred embodiment valve means 47 is a solenoid actuated valve, comprising solenoid 51 which opens and closes valve 53 so that valve 53 is opened by solenoid 51 when an electrical potential is applied to the terminals of the solenoid. When valve means 47 is in the opened position, water is permitted to flow through the valve means and into the building. When valve means 47 is in the closed position, water is prevented from flowing through the valve means into the building.

The present invention also preferably includes control means responsive to the alarm system for operating valve means 47 from an external power source 55. For example, the control means can be an electrically controlled air valve responsive to the alarm system controlling a supply of air which operates an air controlled valve means for insertion into the primary water supply of the building, the control means can be an electrically controlled hydraulic valve responsive to the alarm system controlling a supply of hydraulic fluid which operates a hydraulic controlled valve means, the control means can be a servo or other means for controlling the valve means, as will now be apparent to those skilled in the art. In the preferred embodiment, the control means is a relay 57 including a coil 59 attached to terminals 5 and 23 of alarm system 41. Relay 57 also includes a set of normally closed contacts 61 comprising a relay switch arm 63 and contact 65, which are in series with external power source 55. When alarm system 41 enters the armed condition and develops an electrical potential across terminals 5 and 23, the control means is caused to enter an armed state. In the preferred embodiment, when in the armed state, coil 59 causes normally closed contacts 61 to open, interrupting the flow of electricity to solenoid 51, which closes valve 53, preventing the flow of water into the building through valve means 47. When alarm system 41 leaves the armed condition and enters the "safe" condition, the electrical potential is removed from terminals 5 and 23, causing the control means to enter the unarmed state. In the preferred embodiment, when in the unarmed state, coil 59 does not prevent normally closed contacts 61 from being closed, allowing the flow of electricity to solenoid 51, which opens valve 53, allowing the flow of water into the building through valve mean 47. Relay 57 must be chosen to be of a type having sufficient voltage and current-carrying capacity across contacts 61 to drive solenoid 51. The selection of relay 57 must also be made so that the voltage and current required by coil 59 is capable of being supplied by terminals 5 and 23 of alarm system 41. The details of this relay selection will be well known to those skilled in the art. However, other means of switching power to solenoid 51 could be used without departing from the spirit and scope of the present invention.

It is often desirable to manually shut off the water supply into the building when alarm system 41 is in the safe condition. The need for such a manual shut-off means for forcing valve means 47 into the closed position will be apparent, for example, during periods of maintenance, or when building occupants return, disarm the alarm system, which allows water to flow into the building, and discover that the pipes in the building have burst or developed a leak. In the preferred embodiment, the manual shut-off means for forcing valve means 47 into the closed position is switch 67. When switch 67, which is normally closed, is in the opened position, the flow of electricity is interrupted to solenoid 51, forcing valve 53 to become closed, thus shutting off the flow of water through the valve. However, other shut-off means could be used without departing from the spirit and scope of the present invention.

In the event of power loss to the system, or in the event of malfunction, the present invention may optionally include a manual bypass means for permitting the flow of water into the building when valve means 47 is in the closed position. In the preferred embodiment, the manual bypass means comprises normally closed bypass valve 69 and piping 71 in parallel with valve 53, in a manner well known to those skilled in the art. However, other manual bypass means could be used without departing from the spirit and scope of the present invention. For example, if valve means 47 includes a magnetically controlled valve operated by a solenoid, a suitable permanent magnet means, well known to those skilled in the art, could be used to manually open the valve.

Alternatively it will now be apparent to those skilled in the art that alarm system 41 may be designed and constructed so as to directly control valve means 47 in a manner responsive to the armed and unarmed states of the alarm system, so that when the alarm system is armed the valve means 47 is closed and when the alarm system is disarmed the valve means is opened.

Many intrusion alarms are designed to provide protection by dividing the building into a number of monitoring zones, in a manner that is well-known to those skilled in the art. For example, one zone monitored by the alarm system may be the periphery of the building, with associated switches and alarm sensors attached to windows and exterior doors to the building. Another monitoring zone might be an interior zone, with associated floor mat switches, motion detectors, and alarm sensors attached to interior doors within the building. Such an interior zone is often designated as an "away" zone, since it will be activated only when persons are away from the building, while a perimeter or exterior zone monitoring the periphery of the building might be activated, and the associated alarm circuits armed, even when persons are inside the building with the away zone being disarmed, for protection against unwanted intruders. In such an alarm system, the present invention might be attached to the alarm system in such a manner as will be obvious to those skilled in the art so as to shut off the primary water supply to the building only when the "away" zone alarm system is in the armed condition, thus allowing normal use of water in the building when persons are in the building and the alarm system monitoring the periphery of the building is in the armed condition.

Figure 2:
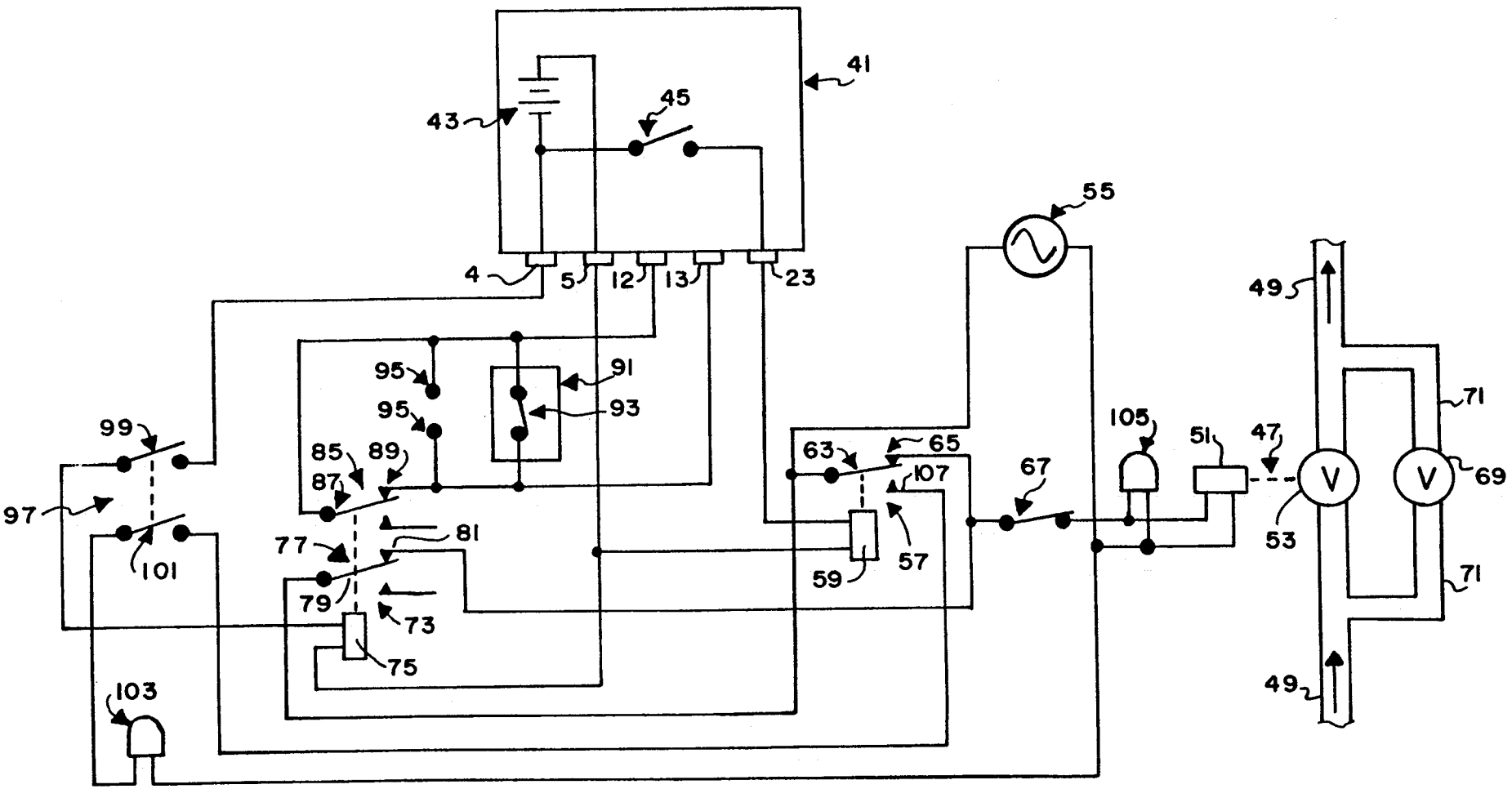
FIG. 2 is a more detailed diagram showing the present invention attached to an intrusion alarm system, such as a Moose Products Inc. model MPI-25 Security Control, with additional circuitry to provide a separate "away" zone monitoring the interior of a building.

Some alarm systems do not provide a plurality of monitoring zones, but are restricted to a single alarm zone. The present invention may be adapted for use with a single-zone alarm system in a manner that provides for the addition of an "away" zone monitoring capability that may be separately armed from the exterior, or perimeter zone which monitors the periphery of the building. FIG. 2 shows the present invention adapted in such a manner for use with such an alarm system 41, such as the model MPI-25 Security Control system, manufactured by Moose Products Inc., 1510 Tate Blvd., S.E., P.0. Box 2904, Hickory, N.C., 28603-2904. It should be noted that the reference designators for terminals 4, 5, 12, 13, and 23 in FIG. 2 correspond to the actual terminal numbers used on the MPI-25 alarm system. It should also be noted that the arming circuit within the MPI-25 alarm, shown symbolically as switch 45, may not reflect the actual circuit used within the alarm system, but is intended to represent the arming function performed by alarm system 41, ie., to develop an electrical potential across terminals 5 and 23 when alarm system 41 is in the armed condition.

As shown in FIG. 2, alarm system 41 provides a continuous electrical potential across terminals 4 and 5 for powering external circuitry. When in the armed condition, alarm system 41 provides an electrical potential across terminals 5 and 23. Alarm system 41 also includes terminals 12 and 13, which connect to circuitry, not shown, within the alarm system, which monitors the presence or absence of an external connection between terminals 12 and 13 whenever the alarm system is in the armed condition. This circuitry may be made to activate an alarm, such as a bell or a light, whenever the absence of a connection is detected across terminals 12 and 13 when the alarm is in the armed condition, in a manner well-known to those skilled in the art. Those skilled in the art of alarm systems will recognize that it is customary to operate such an alarm system by providing an away zone intrusion detector 91, which might typically contain at least one normally-closed switch 93, attached across terminals 12 and 13 in a manner such that the opening of switch 93 may be detected by circuitry, not shown, within alarm system 41. Those skilled in the art will also recognize that it is customary to provide shunt terminals 95, across terminals 12 and 13, which may be connected together to disable intrusion detector 91.

FIG. 2 shows how the present invention may be modified to control a circuit across terminals 12 and 13 in order to provide an "away" zone, as might be used in the interior of the building. The elements of FIG. 2 corresponding to elements of FIG. 1 perform substantially the same function as described above in the discussion of the operation of FIG. 1.

As shown in FIG. 2, a second control means is provided for operating valve means 47 in addition to relay 57; in the preferred embodiment, this second control means is a second relay 73, including a first set of normally-closed contacts 77, comprising relay switch arm 79 and normally-closed contact 81, connected in parallel with relay switch arm 63 and normally-closed contact 65 of relay 57. Second relay 73 also includes a second set of normally-closed contacts 85, comprising relay switch arm 87 and normally-closed contact 89, connected across shunt terminals 95. Switch arms 79 and 87 move in tandem when an electrical potential is applied across or removed from coil 75 of relay 73, in a manner well known to those skilled in the art, causing contacts 77 and 85 to open or close. An armed state for relay 73 is defined as the condition when coil 75 is energized by an electrical potential, and an unarmed state for relay 73 is defined as the condition when coil 75 is not energized by an electrical potential.

An away zone arming circuit, shown in the preferred embodiment as Double Pole Single Throw (DPST) switch 97, comprising switches 99 and 101 operating in tandem, has an armed position and a safe position. When switch 97 is in the safe position, both switches 99 and 101 are open; when switch 97 is in the armed position, both switches 99 and 101 are closed.

When switch 97 is in the armed position, switch 99 causes a circuit to be completed between a power source, such as power source 43, and coil 75 of relay 73, causing an electrical potential to be applied across coil 75, which causes relay 73 to enter the armed state. Similarly, when switch 97 is in the safe position, the electrical potential is removed from coil 75, causing relay 73 to enter the unarmed state. When relay 73 is in the unarmed state, contacts 85 complete a connection across shunt terminals 95, disabling away zone intrusion detector 91, allowing alarm 41 to be armed for the periphery of the building only. Also, when relay 73 is in the unarmed state, contacts 77 provide an alternate means of applying an electrical potential to solenoid 51 due to the parallel connection of contacts 77 of relay 73 with relay switch arm 63 and normally-closed contact 65 of relay 57, thus allowing water to flow into the building while the alarm is armed but the away zone is disarmed.

An optional feature of the circuit shown in FIG. 2 is the provision for an indication that the away zone circuit is in the armed condition and that the alarm is also in the armed condition. Relay 57 additionally comprises a normally-open contact 107 which completes a circuit from external power source 55 through relay switch arm 63 and switch 101 to an indicator, such as lamp 103. As will be obvious to those skilled in the art, lamp 103 will turn on when relay 57 is in the armed state, caused by alarm system 41 being in the armed condition, and when switch 97 is in the armed position, arming the away zone.

Another optional feature of the present invention is the provision for an indication that the electrically controlled valve means is in the opened position. This is accomplished by means of an indicator, such as lamp 105, connected in parallel with solenoid 51. As will be obvious to those skilled in the art, lamp 105 will turn on when an electrical potential is present at the terminals of solenoid 51.

Although the present invention has been described and illustrated with respect to a preferred embodiment and a preferred use therefor, it is not to be so limited since modifications and changes can be made therein which are within the full intended scope of the invention.

I claim:

1. An automatic water shut-off apparatus for protection of a building from water damage comprising the combination of:

(a) an intrusion alarm system including means for arming said intrusion alarm system to provide an armed condition of said intrusion alarm system in which said building is monitored for intrusion and for disarming said intrusion alarm system to provide a safe condition in which time said building is not monitored for intrusion, and (b) valve means inserted in the water supply of the building responsive to the condition of said intrusion alarm system for movement into an open position permitting the flow of water through said valve means when said intrusion alarm system is in said safe condition and for movement into a closed position preventing the flow of water through said valve means when said intrusion alarm system is in said armed condition.

2. An automatic water shut-off apparatus for protection of a building from water damage for attachment to an intrusion alarm system, said alarm system having an armed condition in which the building is monitored for intrusion and a safe condition in which the alarm system is disarmed, comprising the combination of:

(a) valve means for insertion into the water supply for the building, said valve means having an opened position permitting the flow of water through said valve means into said building and a closed position preventing the flow of water through said valve means, and (b) control means operably coupled to the alarm system and responsive to the alarm system for operating said valve means, said control means having an armed state which is entered when the alarm system is in said armed condition and an unarmed state which is entered when the alarm system is in said safe condition, said armed state directing said valve means to enter said closed position and said unarmed state directing said valve means to enter said opened position.

3. An automatic water shut-off apparatus for protection of a building from water damage for attachment to an intrusion alarm system, said alarm system having an armed condition in which the building is monitored for intrusion and a safe condition in which the alarm system is disarmed, comprising the combination of:

(a) valve means for insertion into the water supply for the building, said valve means having an opened position permitting the flow of water through said valve means into said building and a closed position preventing the flow of water through said valve means, (b) manual shut-off means for forcing said valve means into said closed position, and (c) control means responsive to the alarm system for operating said valve means from an external power source said control means having an armed state which is entered when the alarm system is in said armed condition and an unarmed state which is entered when the alarm system is in said safe condition, said armed state directing said valve means to enter said closed position and said unarmed state directing said valve means to enter said opened position.

4. An automatic water shut-off apparatus for protection of a building from water damage, comprising the combination of:

(a) an intrusion alarm system, said alarm system having an armed condition in which the building is monitored for intrusion and a safe condition in which said alarm system is disarmed, (b) valve means for insertion into the water supply for the building, said valve means having an opened position permitting the flow of water through said valve means into said building and a closed position preventing the flow of water through said valve means, and (c) control means responsive to the alarm system for operating said valve means from an external power source, said control means having an armed state which is entered when the alarm system is in said armed condition and an unarmed state which is entered when the alarm system is in said safe condition, said armed state directing said valve means to enter said closed position and said unarmed state direction said valve means to enter said opened position.

5. The apparatus of claim 4, wherein said control means comprises a relay having a set of normally-closed contacts and a coil activated by said alarm system when said alarm system is in said armed condition, and wherein said valve means is connected to the external power source through said set of normally-closed contacts on said relay.

6. The apparatus of claim 4 or claim 5, wherein the apparatus further comprises the combination of manual bypass means for permitting the flow of water into the building when said valve means is in said closed position.

7. The apparatus of claim 6, wherein said manual bypass means is a bypass valve and piping in parallel with said valve means.

8. The apparatus of claims 2, 3, or 4 in which said alarm system has an interior zone having an armed condition and a disarmed condition, and an exterior zone having an armed condition and a disarmed condition, and in which said control means includes means for directing said valve means to enter said closed position only when said interior zone is in said armed condition.

* * * * *